United States Patent [19]

Emrich et al.

[11] Patent Number: 4,648,589

[45] Date of Patent: Mar. 10, 1987

[54] METHOD AND APPARATUS FOR ALIGNING AND FEEDING SHEETS FOR PRINTING PRESSES

[75] Inventors: Helmut Emrich, Offenbach am Main; Jurgen Wenzel, Hainburg, both of Fed. Rep. of Germany

[73] Assignee: M.A.N.-Roland Druckmaschinen Aktiengesellschaft, Fed. Rep. of Germany

[21] Appl. No.: 788,888

[22] Filed: Oct. 18, 1985

[30] Foreign Application Priority Data

Oct. 18, 1984 [DE] Fed. Rep. of Germany ..... 3438134

[51] Int. Cl.[4] ..... B65H 9/00

[52] U.S. Cl. ..... 271/236; 271/195; 271/250; 271/241

[58] Field of Search ..... 271/236, 230, 231, 238, 271/245, 255, 241, 249, 252

[56] References Cited

U.S. PATENT DOCUMENTS

| | | | |
|---|---|---|---|
| 3,743,277 | 7/1973 | Bolza-Schünemann et al. | 271/250 X |
| 4,060,237 | 11/1977 | Degen et al. | 271/237 X |
| 4,184,673 | 1/1980 | Weisbach | 271/237 |
| 4,260,149 | 4/1981 | Melzer | 271/236 |

*Primary Examiner*—Duane A. Reger

*Assistant Examiner*—Alvin Oberley

*Attorney, Agent, or Firm*—Leydig, Voit & Mayer

[57] ABSTRACT

A method and apparatus for aligning and feeding sheets for printing presses having a conveyor for supplying the sheets individually from a feed stack to the front and side lays in a feed table of the press. The method includes the steps of causing the sheets to strike the front lays, drawing the sheets against a side abutment of the side lay, engaging the sheets from below utilizing a vacuum device and then again pressing the sheets against the front lays.

The apparatus includes a vacuum device and front and side lays. The vacuum device includes suction arms disposed below the sheets and ahead of the front lays with respect to the direction of the sheet movement. The front lays are movable reciprocably in the direction of the sheet movement while the side lays are movable transversely to the direction of the sheet movement. The apparatus also includes: a first cam for pivoting the suction arms, a second cam for reciprocating the side lay, and a suction disc for controlling the negative pressure applied to the suction arms, all of which are secured to a single shaft and adjusted and laid out in an angular position to one another so that the sheet, after having been drawn laterally against the side lays, is again engaged by the suction arms and moved into a final position against the front lays.

9 Claims, 2 Drawing Figures

1
2
3
4
5
6
7
8
9
10
11
12
13
14
15
16
17
18
19
20
21
22
25
26
27
II
I

METHOD AND APPARATUS FOR ALIGNING AND FEEDING SHEETS FOR PRINTING PRESSES

FIELD OF THE INVENTION

The present invention relates generally to a method and apparatus for aligning and feeding sheets in printing presses having conveying means for supplying the sheets individually from a feed stack to the front and side lays in the feed table of the press, and more particularly concerns a method and apparatus wherein the sheets first strike the front lay and are then drawn against a side abutment of the side lay.

BACKGROUND OF THE INVENTION

U.K. patent specification No. 564,322 discloses an apparatus of the general kind to which the present invention relates. However, the apparatus disclosed there has no provision for correcting longitudinal displacement of the sheet which occurs during the lateral alignment of the sheet.

European patent application No. 5,863 discloses a side aligner of the general type as the apparatus of the present invention. In this apparatus lateral alignment proceeds after the sheets have been aligned on the front lays. Again, however, this leads to some longitudinal shifting of the sheet with the result of register differences in the printing press.

OBJECTS AND SUMMARY OF THE INVENTION

It is the primary aim of the present invention to improve the feed register of sheets in a printing press and more particularly to correct longitudinal shifts experienced as a result of the subsequent side alignment of a sheet previously aligned on the front lays.

In carrying out the invention, a method of aligning and feeding sheets for printing presses having conveying means for supplying the sheets individually from a feed stack to the front and side lays in a feed table of the press, is provided wherein the steps of: causing the sheets to first strike the front lays, then drawing the sheets against a side abutment of the side lay are carried out and characterized in that after the side-drawing step the sheets are engaged from below by vacuum means and are again pressed against the front lays.

An apparatus for performing the method according to the invention comprises vacuum means, front and side lays, the vacuum means including suction arms disposed below the sheets and ahead of the front lays with respect to the direction of sheet movement and being reciprocable in the latter direction, the side lays being movable transversely to the direction of sheet movement, and characterized in that the apparatus includes: a first cam for pivoting the suction arms, a second cam for reciprocating the side lay, and a suction disc for controlling the negative pressure applied to the suction arms all being secured to a single shaft and being adjusted and laid out in an angular position to one another so that the sheet, after having been drawn laterally against the side lays, is again engaged by the suction arms and moved into final position against the front lays.

These and other features and advantages of the invention will be more readily apparent upon reading the following description of a preferred exemplified embodiment of the invention and upon reference to the accompanying drawings wherein:

Figures 1, 2:
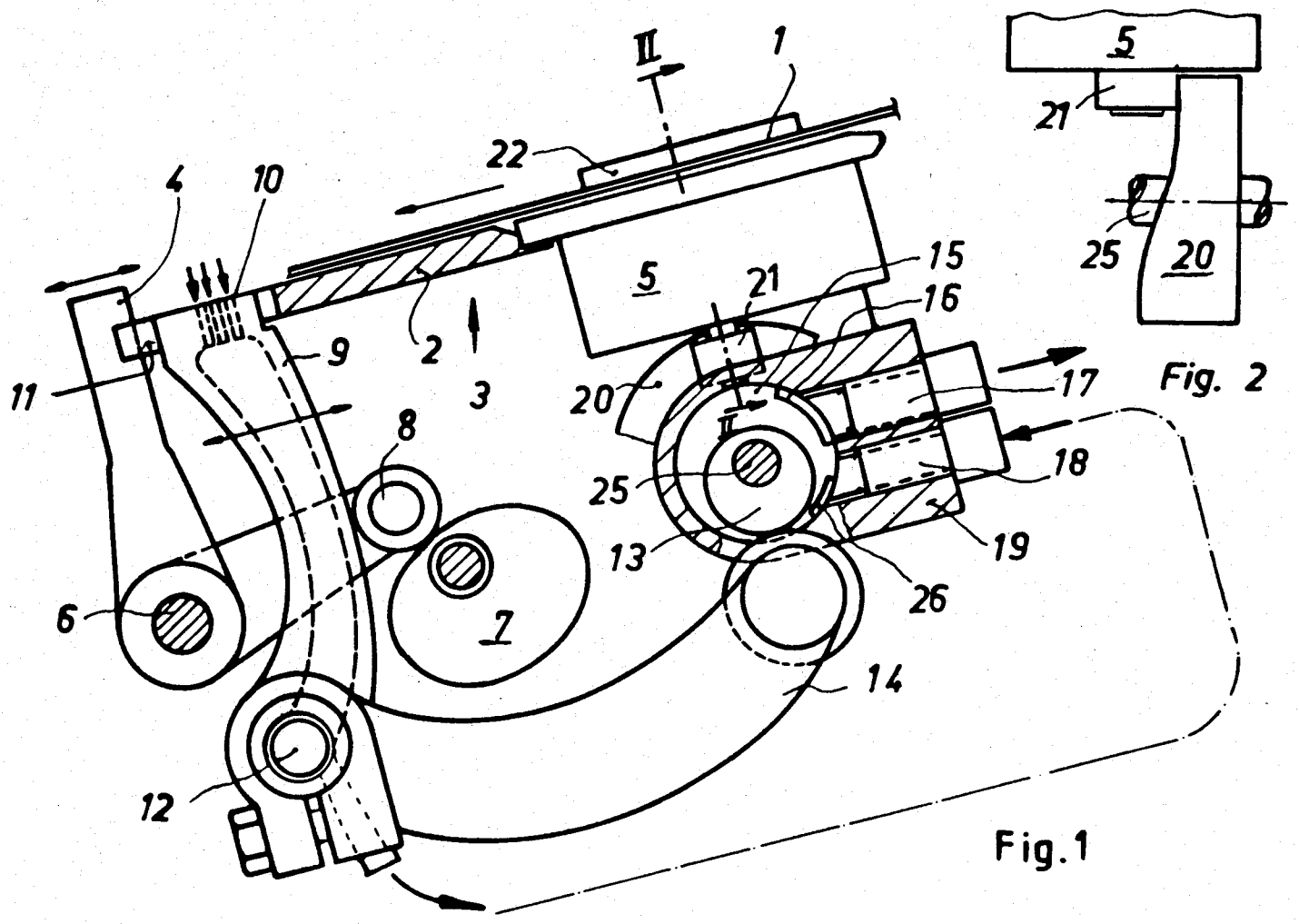
FIG. 1 is a partly sectioned side view of the sheet aligning apparatus of the present invention.
FIG. 2 is an enlarged fragmentary view of part of FIG. 1 substantially as seen along the line II—II thereof.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Turning now to the drawings, sheets 1 for printing in a printing press (not shown) are supplied on a feed table 2 to an aligning station 3 where they are aligned by front lays 4 and side lays 5 cooperating with the front and side edges of the sheets 1. The front lays 4 are secured to a shaft 6 adapted to be oscillatingly pivoted by way of a cam 7 and a cam-follower lever 8. The front lay 4 can therefore be pivoted into its position for aligning the sheet (as shown in FIG. 1) and then pivoted away from the path of the sheet.

Disposed ahead of the front lays 4, with respect to the direction of sheet movement, are vacuum means including suction arms 9 whose suction surfaces 10 are disposed coplanar with the feed table surface in slots 11 in the feed table 2. The suction arms 9 are secured to a shaft 12 adapted to be osciallatingly pivoted by way of a first cam 13 and cam follower lever 14. A suction disc 15 formed with circumferential recesses 16 is disposed on a shaft 25 so as to be coaxial of the cam 13.

When the disc 15 rotates, the suction arms 9 are connected to a source of negative air pressure (not shown) through ducts 17, 18 of a control casing 19, by way of the recesses 16, and through an appropriate conduit (shown here in dash-lines). Another circumferential recess 26 is disposed at an angular relation to the recess 16. Also secured to the shaft 25 is a second cam 20 (see also FIG. 2) which, by way of a roller follower 21 secured to the side lay 5, moves the same transversely with respect to the direction of sheet movement and thereby moves the engaged sheet 1 against a side alignment abutment 22. Preferably, the movement of the suction arms 9 is only about 2 mm.

Pursuant to the present invention and because the first and second cams 13, 20 and disc 15 for the suction arm movement, the start of suction, the end of suction and the movement of the side lay 5 are all disposed on the same shaft 25, the required sequence of operations with respect to the engagement of the sheets with the front lays can readily be set up. In accordance with the present invention, the preferred method of operation of the sheet aligning apparatus is as follows:

(a) The recess 16 in the disc 15 connects the ducts 17, 18 and a negative air pressure arises on the surfaces 10 of the suction arms 9 causing forward movement of the sheet 1 to be retarded;

(b) The sheet is aligned against the front lays 4;

(c) The side lay 5 moves, engages the sheet and aligns the same laterally against the abutment 22;

(d) The slot 26 reconnects the ducts 17 and 18 and a negative pressure is again operative on the surfaces 10;

(e) The cam 13 actuates the lever 14 and moves the suction arms 9 forward and the sheet 1, previously moved by the lateral alignment operation, is therefore pressed against the front lays again to insure its proper registering in the printing press.

We claim as our invention:

1. A method of aligning and feeding sheets for a printing press having conveying means for supplying the sheets individually from a feed stack to the front and side lays in a feed table of the press, said feed table having vacuum means including suction arms disposed below the sheets and ahead of the front lays with respect to the direction of sheet movement and being reciprocable relative to said direction by first cam means, the side lays being movable transversely to said direction of sheet movement by second cam means, and a suction disc for controlling the negative pressure applied to the suction arms, said first and second cam means and said suction disc being secured to a single shaft and adjustably laid out in angular relation to one another, said method comprising the steps of: causing the sheets to first strike the front lays, then drawing the sheets against a side abutment by the transverse movement of the side lays, and characterized in that after the side-drawing step the sheets are engaged from below by said vacuum means and are again pressed against the front lays by reciprocating said vacuum means.

2. A method according to claim 1, characterized in that the negative pressure for the vacuum means is controlled in relation to the cadence of the sheets reaching the front and side lays so that the sheets experience negative pressure before abutting the front lays and are therefore decelerated.

3. An apparatus for aligning and feeding sheets for a printing press having conveying means for supplying the sheets individually from a feed stack to the press, comprising a feed table having vacuum means and front and side lays, the vacuum means including suction arms disposed below the sheets and ahead of the front lays with respect to the direction of sheet movement and being reciprocable in the longitudinal direction, the side lays being movable transversely to the direction of sheet movement, characterized in that the apparatus includes a first cam for pivoting the suction arms in said longitudinal direction, a second cam for reciprocating the side lays in said transverse direction, and a suction disc for controlling the, negative pressure applied to the suction arms, said first and second cam means and said suction disc being secured to a single shaft and being adjusted and laid out in an angular position to one another so that the sheet, after having been drawn laterally against an abutment by reciprocating the side lays, is again engaged by the suction arms and moved into final position against the front lays by pivoting of the suction arms.

4. An apparatus according to claim 3, further characterized in that the suction disc is formed with two circumferentially disposed control slots.

5. An apparatus according to claim 3, further characterized in that at least two suction arms are disposed tangentially to the direction of sheet movement towards the front lays and perpendicularly to the side lay below the feed table.

6. An apparatus according to claim 5, further characterized in that the operative movement of the suction arms relative to the feed table surface is approximately 2 to 4 mm.

7. An apparatus according to claim 4, further characterized in that the suction arms can be rendered operative briefly by means of the second recess in the suction disc at the time when the sheet engages the front lays.

8. An apparatus according to claim 3, further characterized in that the suction arms are adapted for individual variable control of the negative air pressure.

9. An apparatus according to claim 8, further characterized in that the suction arms and the side lay have a common negative air pressure source.

* * * * *